US009325070B1

(12) United States Patent
Obeidat et al.

(10) Patent No.: US 9,325,070 B1
(45) Date of Patent: Apr. 26, 2016

(54) DUAL-LOOP-SLOT ANTENNA

(71) Applicant: AMAZON TECHNOLOGIES, INC., Reno, NV (US)

(72) Inventors: Khaled Ahmad Obeidat, Santa Clara, CA (US); Mark Corbridge, Los Gatos, CA (US); Ming Zheng, Cupertino, CA (US); Joseph Christopher Modro, Palo Alto, CA (US)

(73) Assignee: Amazon Technologies, Inc., Reno, NV (US)

( * ) Notice: Subject to any disclaimer, the term of this patent is extended or adjusted under 35 U.S.C. 154(b) by 283 days.

(21) Appl. No.: 13/925,467

(22) Filed: Jun. 24, 2013

(51) Int. Cl.
*H01Q 1/24* (2006.01)
*H01Q 9/04* (2006.01)

(52) U.S. Cl.
CPC ..... *H01Q 9/0407* (2013.01)

(58) Field of Classification Search
CPC ..... H01Q 1/243; H01Q 13/10; H01Q 13/106
USPC ..... 343/702, 767
See application file for complete search history.

(56) References Cited

U.S. PATENT DOCUMENTS

| | | | | |
|---|---|---|---|---|
| 6,853,341 | B1 * | 2/2005 | Hellgren | H01Q 1/3275 343/742 |
| 2006/0017635 | A1 * | 1/2006 | Zheng | 343/748 |
| 2007/0222699 | A1 * | 9/2007 | Modro | H01Q 1/243 343/873 |
| 2009/0295567 | A1 * | 12/2009 | Bellows | H01Q 1/2216 340/539.11 |
| 2010/0315303 | A1 * | 12/2010 | Kearney | H01Q 1/36 343/767 |
| 2011/0063180 | A1 * | 3/2011 | Su | H01Q 3/24 343/795 |

* cited by examiner

*Primary Examiner* — Dameon E Levi
*Assistant Examiner* — Collin Dawkins
(74) *Attorney, Agent, or Firm* — Lowenstein Sandler LLP

(57) ABSTRACT

Antenna structures and methods of operating the same of a dual-loop-slot antenna of an electronic device are described. One dual-loop-slot antenna includes a first loop antenna coupled to a radio frequency (RF) feed and a ground plane, a second loop coupled to the RF feed and the ground plane. At least a portion of the second loop antenna is formed by the first loop antenna. The dual-loop-slot antenna also includes a slot antenna formed at least in part by a portion of at least one of the first loop antenna or the second loop antenna.

20 Claims, 10 Drawing Sheets

DUAL-LOOP-SLOT ANTENNA

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Antenna structures and methods of operating the same of a dual-loop-slot antenna of an electronic device are described.

One dual-loop-slot antenna includes a first loop antenna coupled to a radio frequency (RF) feed and a ground plane, a second loop coupled to the RF feed and the ground plane. At least a portion of the second loop antenna is formed by the first loop antenna. The dual-loop-slot antenna also includes a slot antenna formed at least in part by a portion of at least one of the first loop antenna or the second loop antenna. Another dual-loop-slot antenna includes a cascaded dual-loop and slot antenna structure coupled to an RF feed and coupled to a ground plane, and a slot antenna element formed at least in part by a portion of the cascaded dual-loop and slot antenna structure. The dual-loop-slot antenna can be used in a compact single-feed configuration in various portable electronic devices, such as a tablet computer, mobile phones, personal data assistances, electronic readers (e-readers), or the like. In a single-feed antenna, both bandwidth and efficiency in the high-band can be limited by the space availability and coupling between the high-band antenna and the low-band antenna in a compact electronic device. The dual-loop-slot antenna can be used to improve radiation efficiency in desired frequency bands.

The dual-loop-slot antenna can be used for wide band performance for Long Term Evolution (LTE) frequency bands, third generation (3G) frequency bands, or the like. In one implementation, the dual-loop-slot antenna can be configured to operate with two resonances in a low-band of the 3G/LTE frequency bands and with four resonances in a high-band of the 3G/LTE frequency bands.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
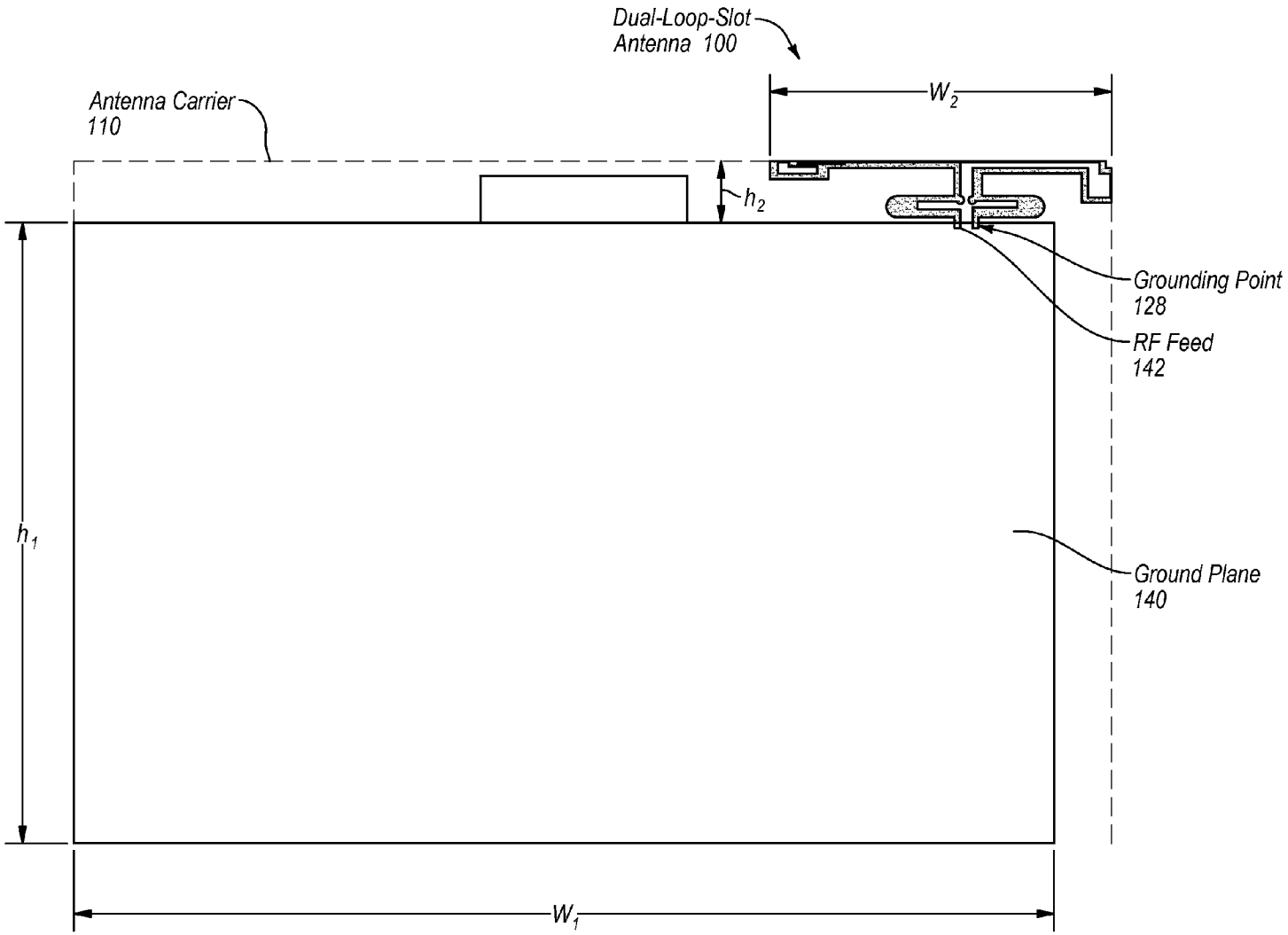
FIG. 1 is a front view of a dual-loop-slot antenna according to one embodiment.

FIG. 1 is a front view of a dual-loop-slot antenna 100 according to one embodiment. The dual-loop-slot antenna 100 can be disposed in an electronic device that includes circuitry that drives a single radiation frequency (RF) feed. In FIG. 1, the ground is represented as a radiation ground plane 140. The ground plane 140 may be a metal frame of the electronic device. The ground plane 140 may be a system ground or one of multiple grounds of the user device. The RF feed 142 may be a feed line connector that couples the dual-loop-slot antenna 100 to a respective transmission line of the electronic device. The RF feed 142 is a physical connection that carries the RF signals to and/or from the dual-loop-slot antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the dual-loop-slot antenna 100. In another embodiment, the feed line connection is connected to the dual-loop-slot antenna with a matching network, such as the $\pi$ matching network described herein. The RF feed 142 is coupled to the dual-loop-slot antenna 100 at a first end of the dual-loop-slot antenna 100 and the dual-loop-slot antenna 100 is coupled to the ground plane 140 at a grounding point 128 at a distal end of the first loop antenna 202, the distal end being an end farthest from the RF feed 142. Although the grounding point 128 is at the distal end of the dual-loop-slot antenna 100, the RF feed 142 can be disposed in close proximity to the grounding point, as illustrated in FIG. 1. Alternatively, other configurations of the dual-loop-slot antenna 100 are possible as would be appreciated by one of ordinary skill in the art having the benefit of this disclosure.

In one embodiment, the dual-loop-slot antenna 100 is disposed on an antenna carrier (not illustrated), such as a dielectric carrier of the electronic device. The antenna carrier may be any non-conductive material, such as dielectric material, upon which the conductive material of the dual-loop-slot antenna 100 can be disposed without making electrical contact with other metal of the electronic device. In another embodiment, the dual-loop-slot antenna 100 is disposed on, within, or in connection with a circuit board, such as a printed circuit board (PCB). In one embodiment, the ground plane 140 may be a metal chassis of a circuit board. Alternatively, the dual-loop-slot antenna 100 may be disposed on other components of the electronic device or within the electronic device as would be appreciated by one of ordinary skill in the art having the benefit of this disclosure. It should be noted that the dual-loop-slot antenna 100 illustrated in FIG. 1 is a three-dimensional (3D) structure. However, as described herein, the dual-loop-slot antenna 100 may include two-dimensional (2D) structures, as well as other variations than those depicted in FIG. 1.

In one embodiment, the dual-loop-slot antenna 100 is configured to radiate electromagnetic energy in a first frequency range (e.g., low-band) and in a second frequency range (e.g., high-band), which is higher than the first frequency range. In one embodiment, the first frequency range is between approximately 700 MHz to approximately 1 GHz and the second frequency range is between approximately 1.5 GHz to approximately 2.2 GHz. In another embodiment, a third frequency range can be between approximately 2.59 GHz and approximately 2.69 GHz (band 7) as described herein. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, two low-band modes and six high-band modes. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a single-feed antenna with increased bandwidth in a size that is conducive to being used in a user device.

In the depicted embodiment, the ground plane 140 has a first width ($W_1$) and a first height ($h_1$) and the dual-loop-slot antenna 100 has a second width ($W_2$) and a second height ($h_2$). The first width ($W_1$) may be approximately 170 mm and the first height ($h_1$) is approximately 107.5 mm. The second width ($W_2$) may be approximately 59 mm and the second height ($h_2$) may be 10.6 mm. The dual-loop-slot antenna 100 may have various dimensions based on the various design factors. In another embodiment, the dual-loop-slot antenna 100 has an overall height ($h_2$), an overall width ($W_2$), and an overall depth (d). The overall height (h) may vary, but, in one embodiment, is about 10 mm. The overall width ($W_2$) may vary, but, in one embodiment, is about 59 mm. The overall depth may vary, but, in one embodiment, is about 0 mm when the dual-loop-slot antenna 100 is a 2D structure. In one embodiment, the overall depth may be 0-5 mm and portions of the dual-loop-slot antenna 100 can be wrapped around different sides of the antenna carrier when the dual-loop-slot antenna 100 is a 3D structure. It should also be noted that various shapes for the dual-loop-slot antenna 100 are possible. For example, the dual-loop-slot antenna structure can have various bends, such as to accommodate placement of other components, such as a speakers, microphones, USB ports.

Strong resonances are not easily achieved within a compact space within user devices, especially within the spaces on smart phones and tablets. The structure of the dual-loop-slot antenna 100 provides strong resonances at a first frequency range of approximately 700 MHz to approximately 1 GHz and at a second frequency range of approximately 1.5 GHz to approximately 2.2 GHz. Alternatively, the structure of the dual-loop-slot antenna 100 provides strong resonances at other frequency ranges. These resonances can be operated in separate modes or may be operated simultaneously. Strong resonances, as used herein, refer to a significant return loss at those frequency bands, which is better for impedance matching to 50-ohm systems. These multiple strong resonances can provide an improved antenna design as compared to conventional designs.

Figure 2:
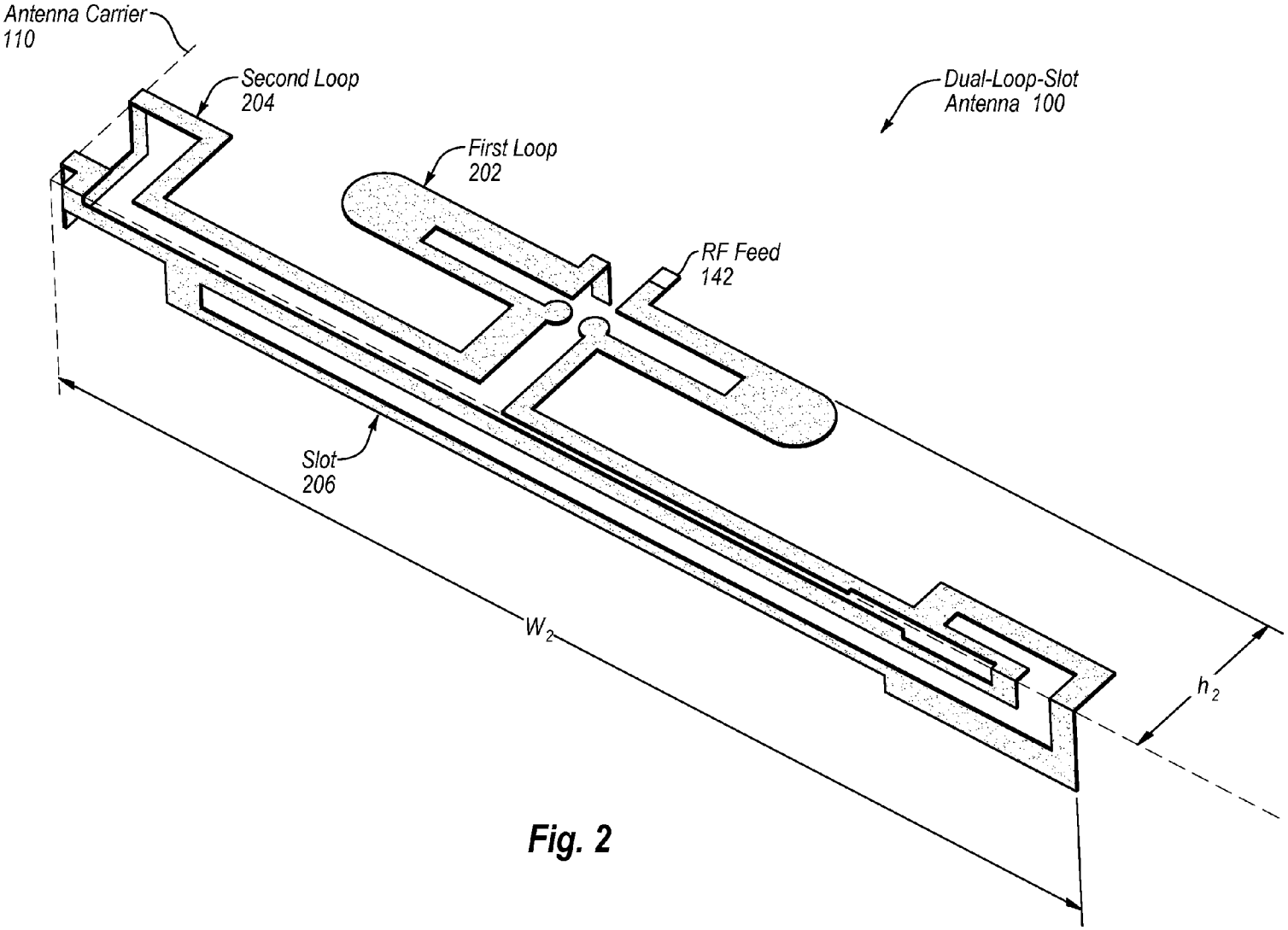
FIG. 2 is a perspective view of the dual-loop-slot antenna of FIG. 1 according to one embodiment.

FIG. 2 is a perspective view of the dual-loop-slot antenna 100 of FIG. 1 according to one embodiment. The dual-loop-slot antenna 100 includes a first loop antenna 202, a second loop antenna 204, and a slot antenna 206. An RF feed 142 is coupled to a first end of the dual-loop-slot antenna 100. In particular, the RF feed 142 is coupled to a first end of the first loop antenna 202. The first loop antenna 202 is formed by two conductive traces, one that extends out from the RF feed 142 and another that extends out from a grounding point 228. The two conductive traces are coupled in close proximity at the distal ends that are farthest from the RF feed 142 and the grounding point 228 to form a loop shape (e.g., oval shape) that is substantially symmetrical about a first axis. In this embodiment, there is a gap between the two conductive traces. In a further embodiment, the conductive traces include extension areas that extend towards one another to create a shorter distance between the two conductive traces. These extensions areas may be circular shaped as illustrated in FIG. 2 or may have other shapes. Although there is a gap between the conductive traces, the conductive traces are disposed in close enough proximity to cause surface current to flow between the two conductive traces, forming a loop antenna. In other embodiments, a single trace can be used instead of two conductive traces in which a continuous conductive trace extends from the RF feed 142 to the grounding point 228. The first loop antenna 202 has a first effective length that is roughly the distance between the RF feed 142 along the conductive trace(s) to the grounding point 228. The first effective length of the first loop antenna 202 contributes to six resonances. In one embodiment, the first loop antenna 202 is substantially symmetrical about a first axis and extends to have a width (W) in a longitudinal axis that is substantially perpendicular to the first axis and that is wider than a height (h).

The second loop antenna 204 is formed by the first loop antenna 202 and two conductive traces, one that extends out from the first conductive trace of the first loop antenna 202 and the other that extends out from the second conductive trace of the first loop antenna 202. The second loop antenna 204 has a second effective length that is roughly the distance between the RF feed 142 along the conductive traces, including the conductive traces of the first loop antenna 202, to the grounding point 228. The second effective length also contributes to the six resonances. In one embodiment, the second loop antenna 204 is not symmetrical like the first loop antenna 202, but has an effective width ($W_2$) in the longitudinal axis that is substantially perpendicular to the first axis and that is wider than a height ($h_2$). The effective width ($W_2$) is wider than the width W of the first loop antenna 202 and the effective height $h_2$ is taller than the height (h) of the first loop antenna 202.

In a further embodiment, the dual-loop-slot antenna 100 includes a first portion coupled to the RF feed 142 and a second portion coupled to the ground plane 140. The first portion and the second portion form the first loop antenna 202 having a first effective length. The dual-loop-slot antenna 100 also includes a third portion coupled to the first portion and a fourth portion coupled to the second portion. The first portion, second portion, third portion and fourth portion form a second loop antenna 204 having a second effective length that is longer than the first effective length. In a further embodiment, the first portion includes a first extension area disposed at a first distal end, the first distal end being an end farthest away from the RF feed 142. The second portion includes a second extension area disposed at a second distal end, the second distal end being an end farthest away from the grounding point 228. There is a gap between the first extension area and the second extension area.

The slot antenna 206 is formed at least in part by a portion of the second loop antenna 204. In one embodiment, the dual-loop-slot antenna 100 includes a sixth portion that extends out from an outer perimeter of the second loop antenna 204 to form an opening between the sixth portion and the outer perimeter of the second loop antenna 204. The slot antenna includes a third effective length. In one embodiment, the slot antenna 206 is a half-wave length slot antenna. In another embodiment, the slot antenna 206 is a quarter-wave length slot antenna. In another embodiment, the dual-loop-slot antenna 100 may include one or more additional slots (not illustrated) or notches (not illustrated) for one or more additional resonant modes.

As described herein, the first loop antenna 202 and second loop antenna 204 form a cascaded dual-loop and slot antenna structure. The slot antenna 206 includes a portion that extends out from an outer perimeter of the second loop antenna to form an opening between the portion and the outer perimeter of the second loop antenna. In another embodiment, the slot antenna 206 includes a portion that extends out from an outer perimeter of the first loop antenna 202 to form an opening between the portion and the outer perimeter of the first loop antenna 202. In this embodiment, the second loop antenna 204 is disposed at least partially outside of the slot antenna 206. Alternatively, the slot antenna 206 can be formed in other portions of the cascaded dual-loop and slot antenna structure. The two loop antennas 202,204 and the slot antenna 206 can be mutually connected to one another in other configurations.

In a further embodiment, the first loop antenna 202 includes multiple portions: a first portion that extends from the RF feed 142 in a first direction and curves around a first bend and extends in a second direction until a first extension area; a second portion that extends from the grounding point 228 in the second direction and curves around a second bend and extends in the first direction until a second extension area. The second loop antenna 204 includes multiple portions: the first portion of the first loop antenna 202, a third portion that extends in a third direction from the first extension area until a first fold; a fourth portion that extends in the first direction from the first fold until a second fold; a fifth portion that extends in the third direction until a third fold; a sixth portion that extends from the third fold in the second direction until a fourth fold; a seventh portion that extends from the fourth fold in a fourth direction until a fifth fold; an eight portion that extends from the fifth fold in the first direction until a sixth fold; a ninth portion that extends from the sixth fold in the fourth direction until the second extension area of the second portion of the first loop antenna 202; and the second portion of the first loop antenna 202. In the depicted embodiment, the dual-loop-slot antenna 100 has a section in the second loop antenna 204 that is folded in the fourth direction towards the ground plane 140 and folded over a side of the antenna carrier. This can be done to fit the dual-loop-slot antenna structure in a smaller volume while maintaining the overall length of the second loop antenna 204. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device. The slot antenna 206 includes multiple portions of conductive material that form the slot opening of the slot antenna 206: a tenth portion that extends from the fourth portion of the second loop antenna 204 in the fourth direction until a seventh fold; an eleventh portion that extends from the seventh fold in the first direction until an eighth fold; a twelfth portion that extends from the eighth fold in the third direction until an ninth fold; a thirteenth portion that extends from the ninth fold in the second direction until a tenth fold; and a fourteenth portion that extends from the tenth fold until the sixth portion. The slot opening is formed by an outer perimeter of the fourth, fifth, and sixth portions of the second loop antenna 204 and an inner perimeter of the tenth, eleventh, twelfth, thirteen, and fourteenth portions.

The dual-loop-slot antenna 100 may have various dimensions based on the various design factors. In one embodiment, the dual-loop-slot antenna 100 has an overall height ($h_2$), an overall width ($W_2$), and an overall depth ($d_2$). The overall height ($h_2$) may vary, but, in one embodiment, is about 10.6 mm. The overall width ($W_2$) may vary, but, in one embodiment, is about 59 mm. The overall depth ($d_2$) may vary, but, in one embodiment, is about 4 mm. The first loop antenna 202 has a width (W) that may vary, but, in one embodiment, is 27.5 mm. The first loop antenna 202 has a height (h) that may vary, but, in one embodiment, is 3.7 mm. The first loop antenna 202 has a first effective length that may vary, but, in one embodiment, is 52 mm. The second loop antenna 204 has a width (W) that may vary, but, in one embodiment, is 58.2 mm. The second loop antenna 204 has a height (h) that may vary, but, in one embodiment, is 12.1 mm when the dual-loop-slot antenna 100 is a 2D structure. In another embodiment, the second loop antenna 204 has a height (h) of 7.1 mm when the dual-loop slot antenna 100 is a 3D structure (portions of the second loop antenna 204 are folded over a side of the antenna carrier. The second loop antenna 204 has a second effective length that may vary, but, in one embodiment, is 130 mm. The slot antenna 206 has a width (W) that may vary, but, in one embodiment, is 49 mm. The slot antenna 206 has a height (h) that may vary, but, in one embodiment, is 3.2 mm. The slot antenna 206 has a third effective length that may vary, but, in one embodiment, is 50 mm. In a further embodiment, the slot antenna 206 is a half-wave length.

In this embodiment, the dual-loop-slot antenna 100 is a 3D structure as illustrated in the perspective view of FIG. 2. In other embodiments, the second loop antenna 204 and slot antenna 206 are 3D structures that wrap around different sides of the antenna carrier and the first loop antenna 202 is a 2D disposed on a front side of the antenna carrier. Of course, other variations of layout may be used for the first loop antenna 202, second loop antenna 204 and the slot antenna 206.

As described above, the dual-loop-slot antenna 100 of FIG. 2 can be disposed on an antenna carrier (not illustrated). The dual-loop-slot antenna 100 is a 3D structure with some portions disposed on different sides of the antenna carrier. However, as described herein, the dual-loop-slot antenna 100 may include 2D structures, as well as other variations than those depicted in FIG. 2.

In one embodiment, the cascaded dual-loop and slot antenna structure illustrated in FIG. 2 is configured to radiate electromagnetic energy in a first frequency range (e.g., low-band) and in a second frequency range (e.g., high-band). The second frequency range is higher than the first frequency range. In one embodiment, the first frequency range is between approximately 700 MHz to approximately 1.0 GHz and the second frequency range is between approximately 1.5 GHz to approximately 2.2 GHz. The embodiments described herein are not limited to use in these frequency ranges, but could be used to increase the bandwidth of a multi-band frequency in other frequency ranges, as described herein. The antenna structure may be configured to operate in multiple resonant modes. For example, in another embodiment, the antenna structure may include one or more additional slot antennas in the antenna structure to create one or more additional resonant modes. In another embodiment, the antenna structure may include additional elements, such as a parasitic ground element (e.g., a monopole that extends from the ground plane that couples to the other antenna elements), to create an additional resonant mode. In one embodiment, the additional resonant mode can be a seventh resonant mode in a frequency range of approximately 2.59 GHz to approximately 2.69 GHz (band 7). Alternatively, other frequency ranges and other number of resonant modes can be achieved.

In one embodiment, the cascaded dual-loop and slot antenna structure illustrated in FIG. 2 is configured to radiate electromagnetic energy in six resonant modes. In one embodiment, two of the six resonant modes operate in a first frequency range of a standard wireless frequency band and four of the six resonant modes operate in a second higher frequency range of the standard wireless frequency band. For example, the two resonant modes can be used to operate the cascaded dual-loop and slot antenna structure in the low-band of the 3G/LTE frequency band and the four resonant modes can be used to operate the cascaded dual-loop and slot antenna structure in the high-band of the 3G/LTE frequency band. Alternatively, the cascaded dual-loop and slot antenna structure can be used in other standard wireless frequency bands. In a further embodiment, a first resonant mode of the six resonant modes is at approximately 700 MHz, a second resonant mode of the six resonant modes is at approximately 900 MHz, a third resonant mode of the six resonant modes is at approximately 1.5 GHz, a fourth resonant mode of the six resonant modes is at approximately 1.7 GHz, a fifth resonant mode of the six resonant modes is at approximately 1.9 GHz and a sixth resonant mode of the six resonant modes is at approximately 2.17 GHz. Alternatively, the six resonant modes can be centered at other frequencies.

As described herein, strong resonances are not easily achieved within a compact space within user devices, especially within the spaces on smart phones and tablets. The structure of the dual-loop-slot antenna 100 of FIG. 2 provides strong resonances at a first frequency range of approximately 700 MHz to approximately 1.0 GHz and a second frequency range of approximately 1.5 GHz to approximately 2.3 GHz. Alternatively, the structure of the dual-loop-slot antenna 100 provides strong resonances at other frequency ranges. These resonances can be operated in separate modes or may be operated simultaneously. These multiple strong resonances can provide an improved antenna design as compared to conventional designs.

Figure 3:
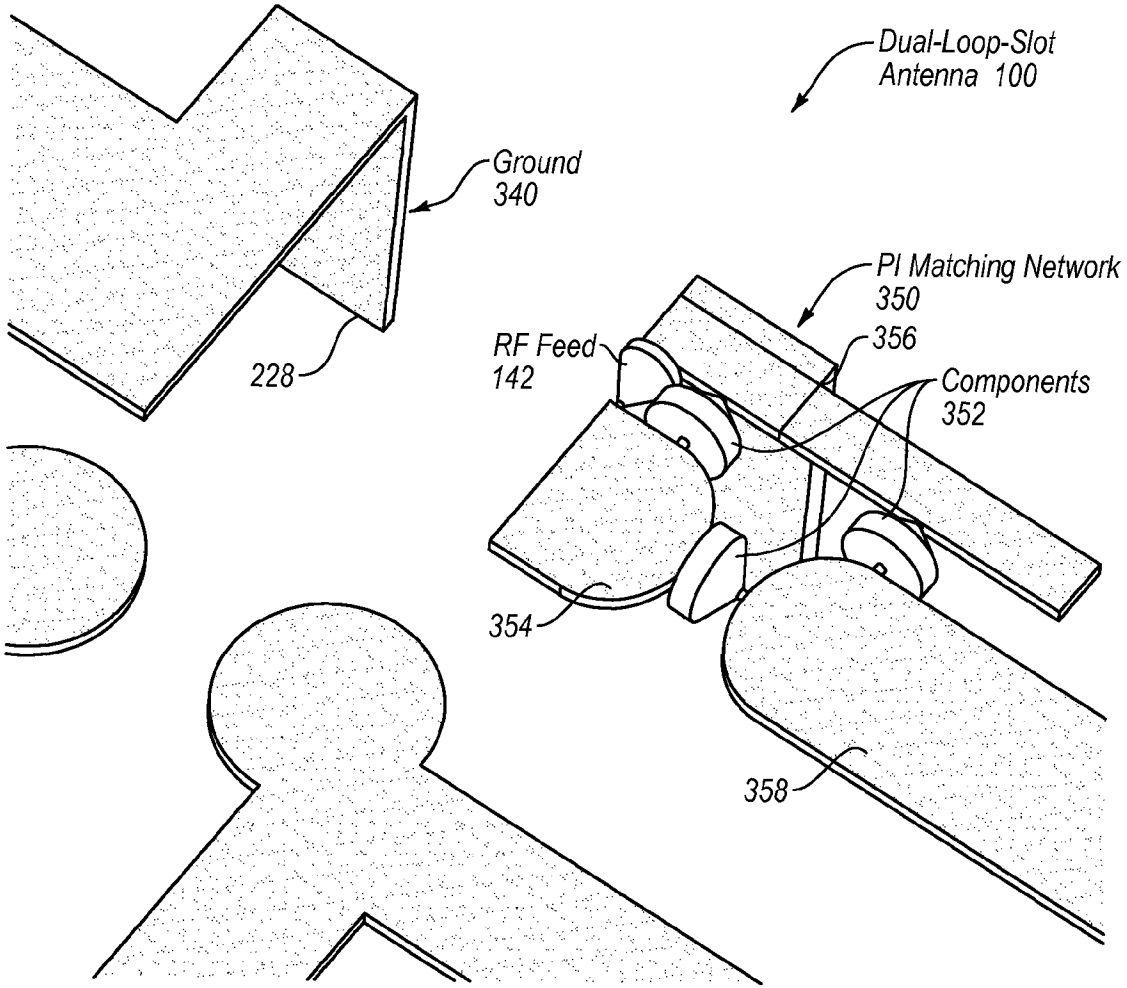
FIG. 3 is a perspective view of a $\pi$ (pi) matching network of the dual-loop-slot antenna of FIG. 1 according to an embodiment.

FIG. 3 is a perspective view of a π matching network 350 of the dual-loop-slot antenna of FIG. 1 according to an embodiment. The "π" refers to the configuration of having two components in parallel with a component coupled between the two parallel components, forming a "π" shape. In one embodiment, the π matching network 350 can be a high-pass matching network, which includes a capacitance coupled in series between an input terminal and an output terminal, a first inductor coupled in parallel between the input terminal and ground and a second inductor coupled in parallel between the output terminal and ground. The π matching network 350 could also be a low-pass matching network, which includes an inductor coupled in series between the input terminal and the output terminal, a first capacitor coupled in parallel between the input terminal and ground and a second capacitor coupled in parallel between the output terminal and ground. Alternatively, other matching networks can be used. The it matching network 350 not only provide impedance matching as other impedance matching circuits, but can also be used to provide a filter to the signal being applied to the antenna.

In the depicted embodiment, the π matching network 350 includes multiple components 352 disposed in a π configuration with two components between a transmission line and ground and one component in series in the transmission line. For example, a section 354 of the dual-loop-slot antenna 100 is coupled to the RF feed 142. A first one of the components 352 (e.g., inductor in high-pass matching network) is coupled between the section 354 and a grounding section 356. A second one of the components 352 (e.g., capacitor in high-pass matching network) is coupled between the section 354 and another section 358 of the dual-loop-slot antenna 100. A third one of the components 352 (e.g., inductor in high-pass matching network) is coupled between the section 358 and the grounding section 356.

Figure 4:
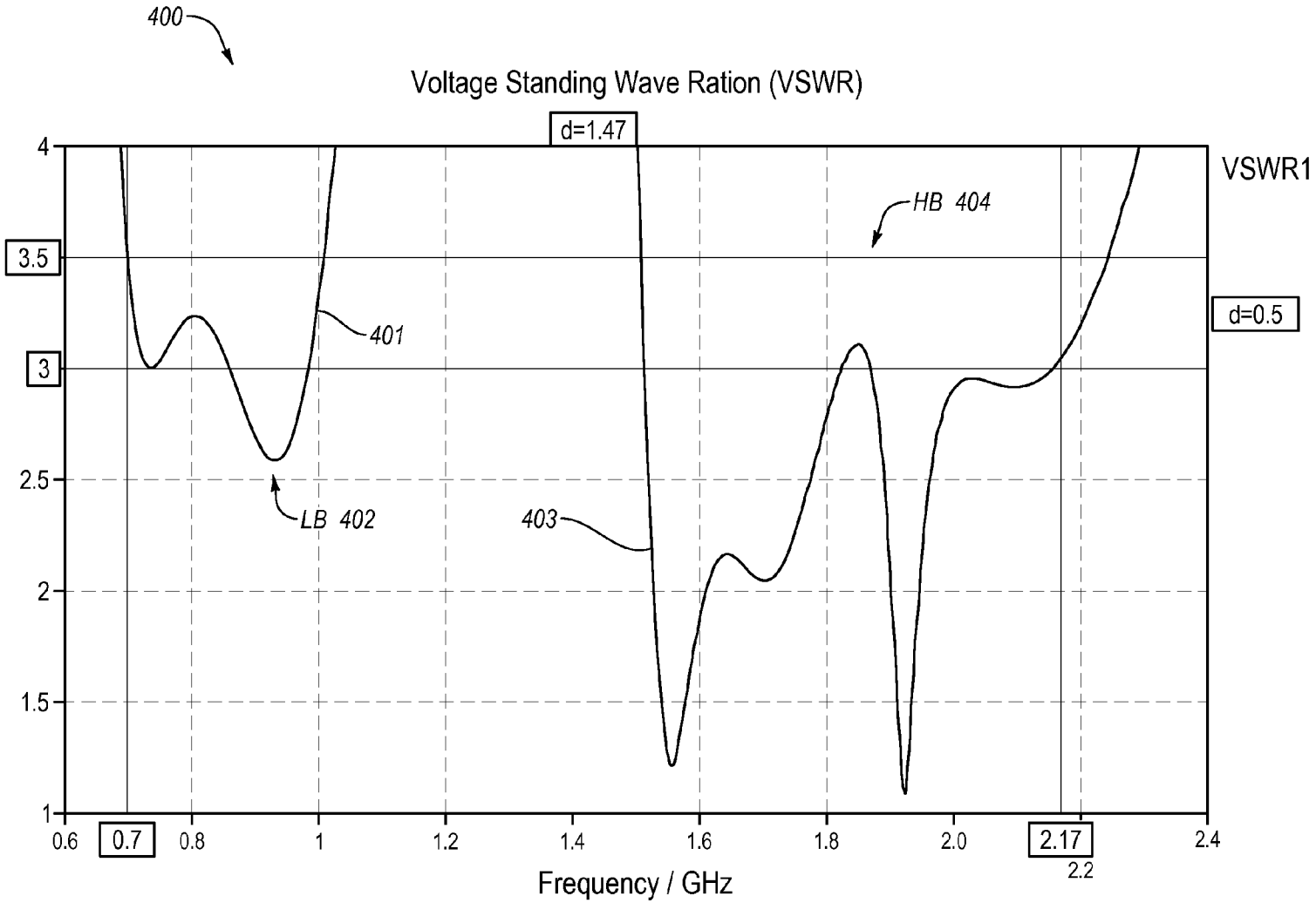
FIG. 4 is a graph of a voltage standing wave ratio (VSWR) of the dual-loop-slot antenna of FIG. 1 according to one embodiment.

FIG. 4 is a graph 400 of a voltage standing wave ratio (VSWR) of the dual-loop-slot antenna of FIG. 1 according to one embodiment. VWSR is used as an efficiency measure for transmission lines for RF signals. A problem with transmission lines is that impedance mismatches in the line tend to reflect the radio waves back toward the source, preventing all the power from reaching the destination end. The voltage component of a standing wave in a uniform transmission line includes the forward wave superimposed on the reflected wave. The reflection coefficient is defined as the reflected wave over the forward wave. VSWR is the ratio of the voltage amplitude of a partial standing wave at an antinode (maximum) to the amplitude at an adjacent node (minimum) in an electrical transmission line. The graph 400 illustrates VSWR 401 in a low band 402 and VSWR 403 in a high-band 404. In this embodiment, there are two resonant modes in the low band 402 and four resonant modes in the high-band 404. The two resonant modes in the low band 402 cover a frequency range of about 700 MHz to about 1 GHz, and the four resonant modes in the high-band 404 cover a frequency range of about 1.5 GHz to about 2.3 GHz.

Figure 5:
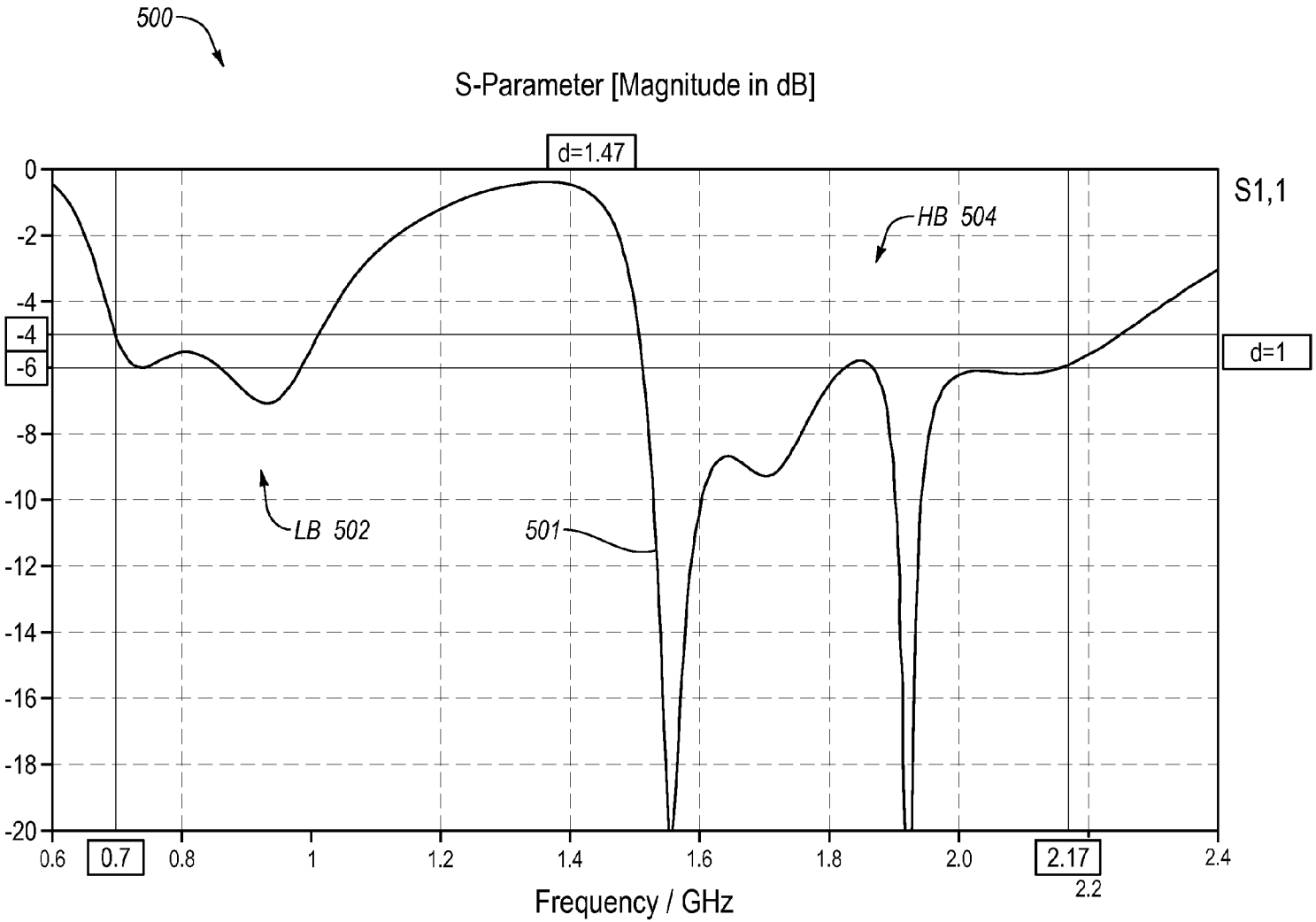
FIG. 5 is a graph of an S-parameter of the dual-loop-slot antenna of FIG. 1 according to one embodiment.

FIG. 5 is a graph 500 of an s-parameter of the dual-loop-slot antenna of FIG. 1 according to one embodiment. The graph 500 shows the S-parameter 501 (also referred to as measured reflection coefficient or |S11|) of the dual-loop-slot antenna 100 of FIG. 1. The graph 500 illustrates that the dual-loop-slot antenna 100 can be caused to radiate electromagnetic energy between approximately 700 MHz to approximately 1 GHz in the low band 502 and between approximately 1.5 GHz to approximately 2.3 GHz in the high-band 504. The dual-loop-slot antenna 100 provides six resonant modes, including two in the low band 502 and four in the high-band 504. The two resonant modes in the low band 502 cover the frequency range of about 700 MHz to about 1 GHz. A first one of the two resonant modes in the low band 502 may be centered at approximately 750 MHz and second one of the two resonant modes in the low band 502 may be centered at approximately 960 MHz The four resonant modes in the high-band 504 cover the frequency range of about 1.5 GHz to about 2.3 GHz. The four resonant modes in the high-band 504 may be centered at approximately 1.55 GHz, approximately 1.7 GHz, approximately 1.96 GHz and approximately 2.15 GHz. As described herein, other resonant modes may be achieved and the resonant modes may cover different frequency ranges and may be centered at different frequencies than those described and illustrated herein.

In other embodiments, more or less than six resonant modes may be achieved as would be appreciated by one of ordinary skill in the art having the benefit of this disclosure. It should also be noted that the first, second, third, fourth and fifth notations on the resonant modes are not be strictly interpreted to being assigned to a particular frequency, frequency range, or elements of the antenna structure. Rather, the first, second, third, fourth and fifth notations are used for ease of description. However, in some instances, the first, second, third fourth and fifth are used to designate the order from lowest to highest frequencies. Alternatively, other orders may be achieved as would be appreciated by one of ordinary skill in the art having the benefit of this disclosure. In one embodiment, the dual-loop-slot antenna 100 can be configured for the LTE (700/2700), UMTS, GSM (850, 800, 1800 and 1900), GPS and Wi-Fi® and Bluetooth® frequency bands. In another embodiment, the dual-loop-slot antenna 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about 6 dB bandwidth (BW). Alternatively, the dual-loop-slot antenna 100 can be designed to operate in different combinations of frequency bands as would be appreciated by one of ordinary skill in the art having the benefit of this disclosure. Alternatively, the dual-loop-slot antenna 100 can be configured to be tuned to other frequency bands as would be appreciated by one of ordinary skill in the art having the benefit of this disclosure.

The dual-loop-slot antenna 100 can be tuned to be centered at various frequencies in the low band 502, such as, for examples, at approximately 740 MHz, at approximately 875 MHz or approximately 925 MHz. The first frequency range can be tuned to radiate electromagnetic energy in Band 1 when centered at approximately 740 MHz, in Band 5 (e.g., GSM 850) when centered at approximately 875 MHz, or in Band 8 (e.g., EGSM 900) when centered at approximately 925 MHz. In other embodiments, the first frequency range can be tuned to be centered at other frequencies in the low band 502.

The dual-loop-slot antenna 100 can be tuned to be centered at various frequencies in the high-band 504, such as, for examples, at approximately 1.77 GHz, at approximately 1.92 GHz or approximately 2.0 GHz. The second frequency range can be tuned to radiate electromagnetic energy in DCS Band 3 when centered at approximately 1.77 GHz, in PCS Band 2 when centered at approximately 1.92 GHz, or in Band 1 when centered at approximately 2.0 GHz. In other embodiments, the second frequency range can be tuned to be centered at other frequencies in the high-band 504.

In one embodiment, the dual-loop-slot antenna 100 is configured to radiate electromagnetic energy at two resonant modes in the low band 502 and four resonant modes in the high-band 504. In one embodiment, the dual-loop-slot antenna 100 covers approximately 700 MHz to approximately 1 GHz in the low-band and approximately 1.5 GHz to approximately 2.3 GHz in the high-band. As described herein, other resonant modes may be achieved. Also, other frequency ranges may be covered by different designs of the dual-loop-slot antenna as would be appreciated by one of ordinary skill in the art having the benefit of this disclosure. The terms "first," "second," "third," "fourth," etc., as used herein, are meant as labels to distinguish among different elements and may not necessarily have an ordinal meaning according to their numerical designation.

Figure 6:
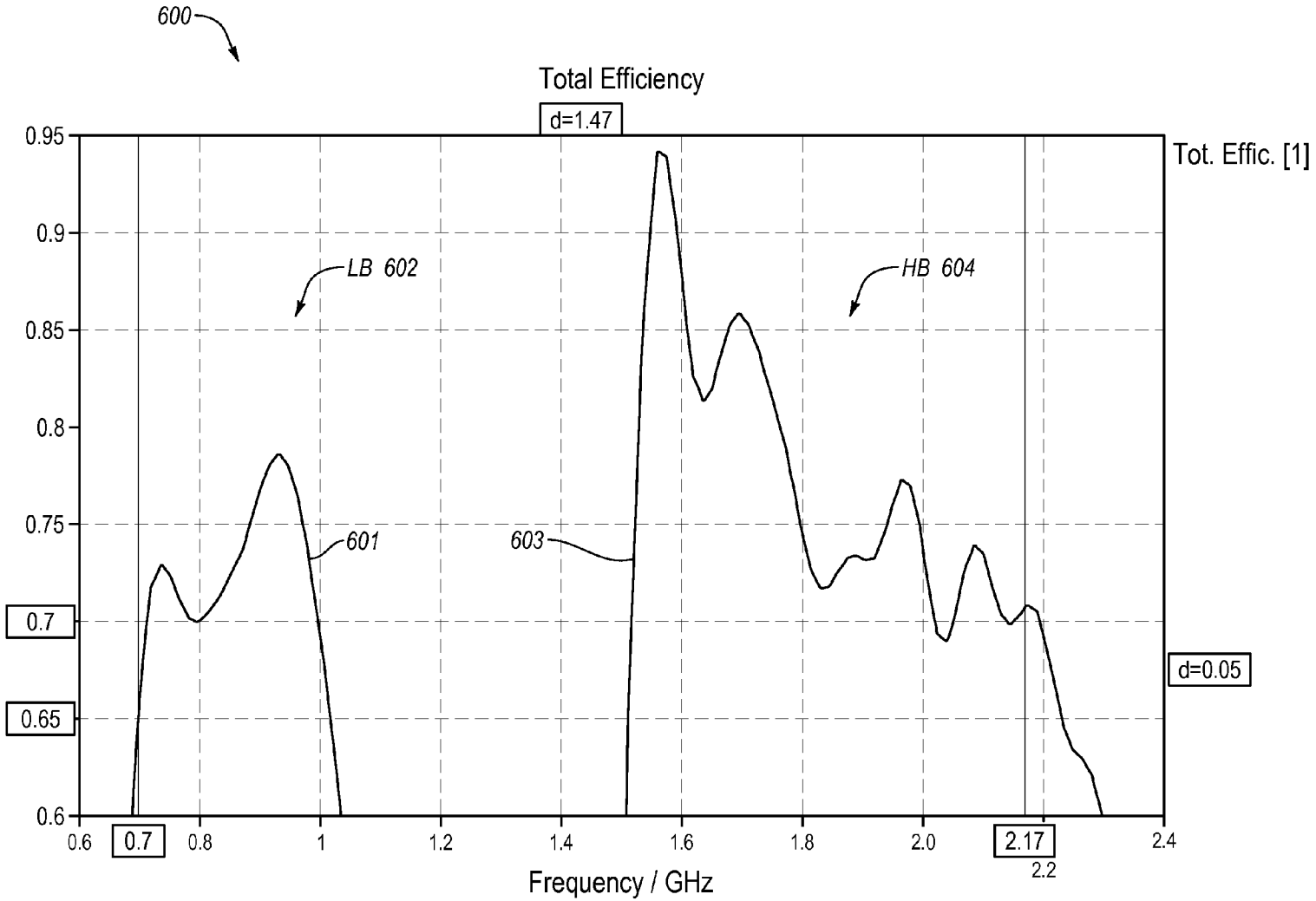
FIG. 6 is a graph of measured efficiencies of the dual-loop-slot antenna of FIG. 1 according to one embodiment.

FIG. 6 is a graph 600 of measured efficiencies of the dual-loop-slot antenna of FIG. 1 according to one embodiment. The graph 600 illustrates the total efficiency 601 over a frequency range in the low-band 602 and the total efficiency 603 over a frequency range in the high-band 504. The graph 600 illustrates that the dual-loop-slot antenna 100 is a viable antenna for the frequency range in the low-band 602 between approximately 700 MHz and approximately 1 GHz and in the high-band between approximately 1.5 GHz and approximately 2.3 GHz.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the dual-loop-slot antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

Figure 7:
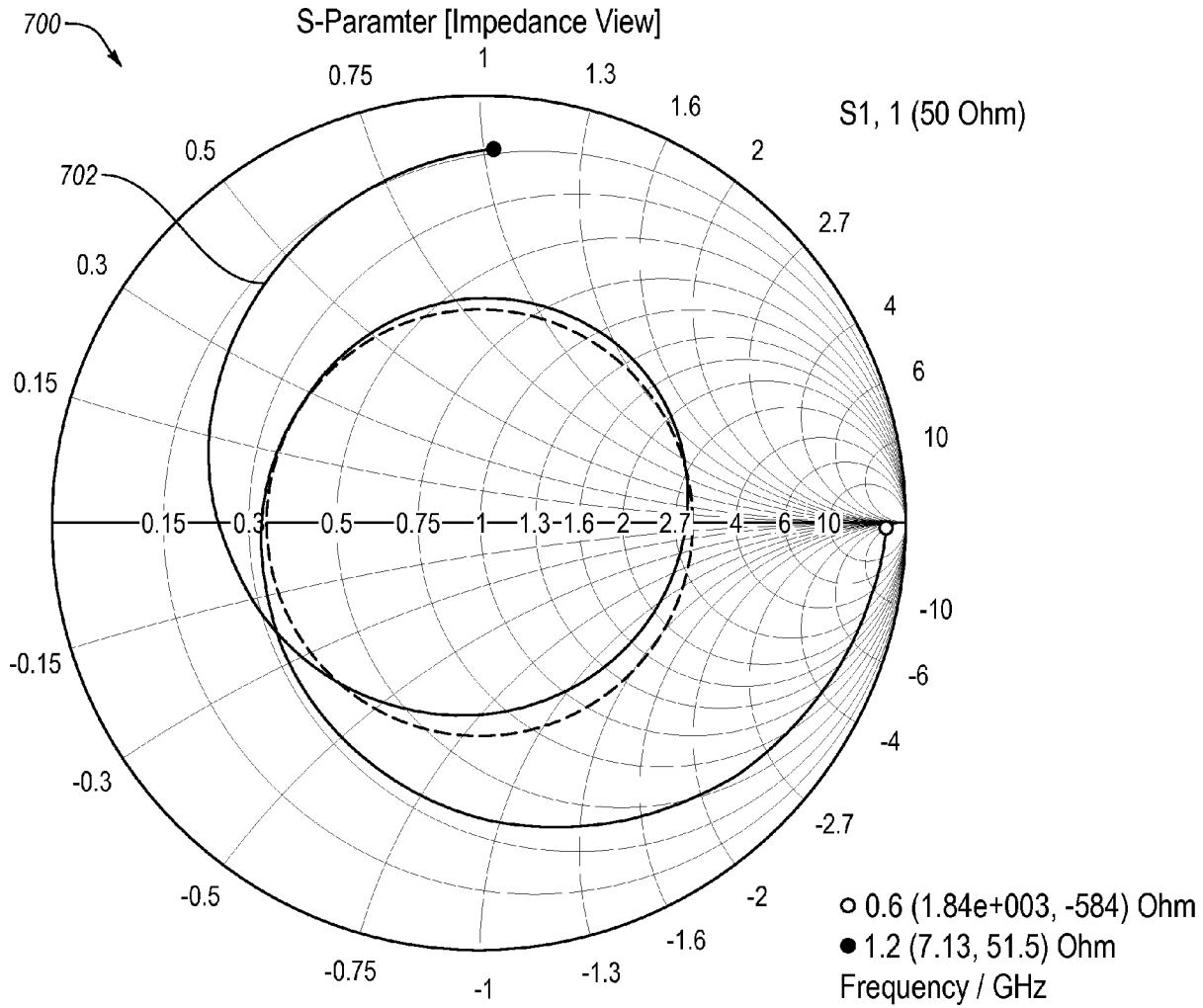
FIG. 7 is a Smith chart of an input impedance of the dual-loop-slot antenna of FIG. 1 in a first frequency range according to one embodiment.

FIG. 7 is a Smith chart 700 of an input impedance of the dual-loop-slot antenna 100 in a first frequency range according to one embodiment. The Smith chart 700 illustrates how the impedance and reactance behave at one or more frequencies for the dual-loop-slot antenna 100 tuned to the low-band between about 600 MHz and about 1.2 GHz. In particular, the line 702 corresponds to the impedance of the dual-loop-slot antenna 100 in this first frequency range. The Smith chart 700 illustrates the dual-loop-slot antenna 100 as having two resonant modes in the low-band as the locus of antenna input impedance on the Smith chart 700 are identified as two loops.

Figure 8:
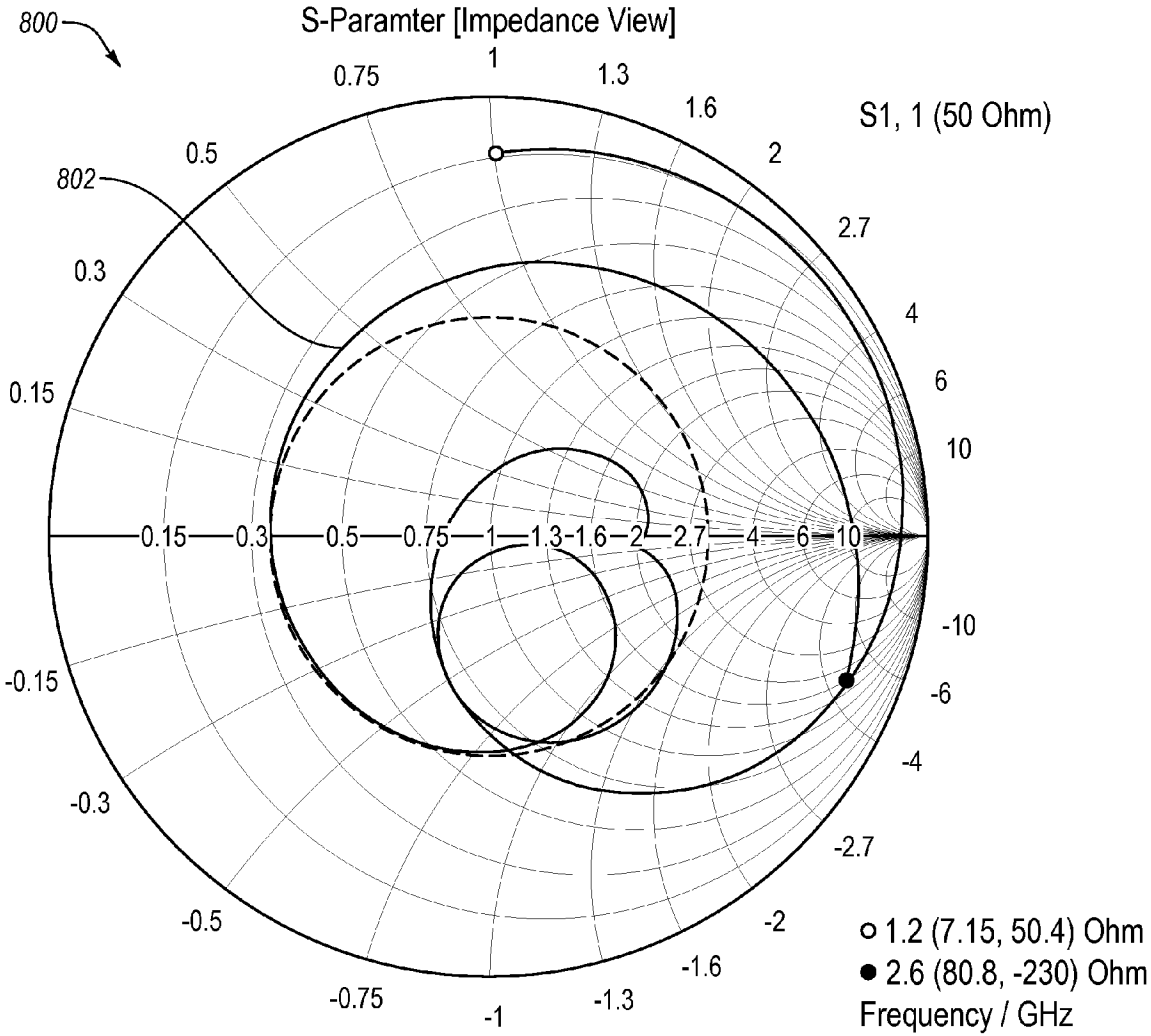
FIG. 8 is a Smith chart of an input impedance of the dual-loop-slot antenna of FIG. 1 in a second frequency range according to one embodiment.

FIG. 8 is a Smith chart of an input impedance of the dual-loop-slot antenna of FIG. 2 in a second frequency range according to one embodiment. The Smith chart 800 illustrates how the impedance and reactance behave at one or more frequencies for the dual-loop-slot antenna 100 tuned to the high-band between about 1.2 GHz and about 2.6 GHz. In particular, the line 802 corresponds to the impedance of the dual-loop-slot antenna 100 in this second frequency range. The Smith chart 800 illustrates the dual-loop-slot antenna 100 as having four resonant modes in the high-band as the locus of antenna input impedance on the Smith chart 800 are identified as four loops.

Figure 9:
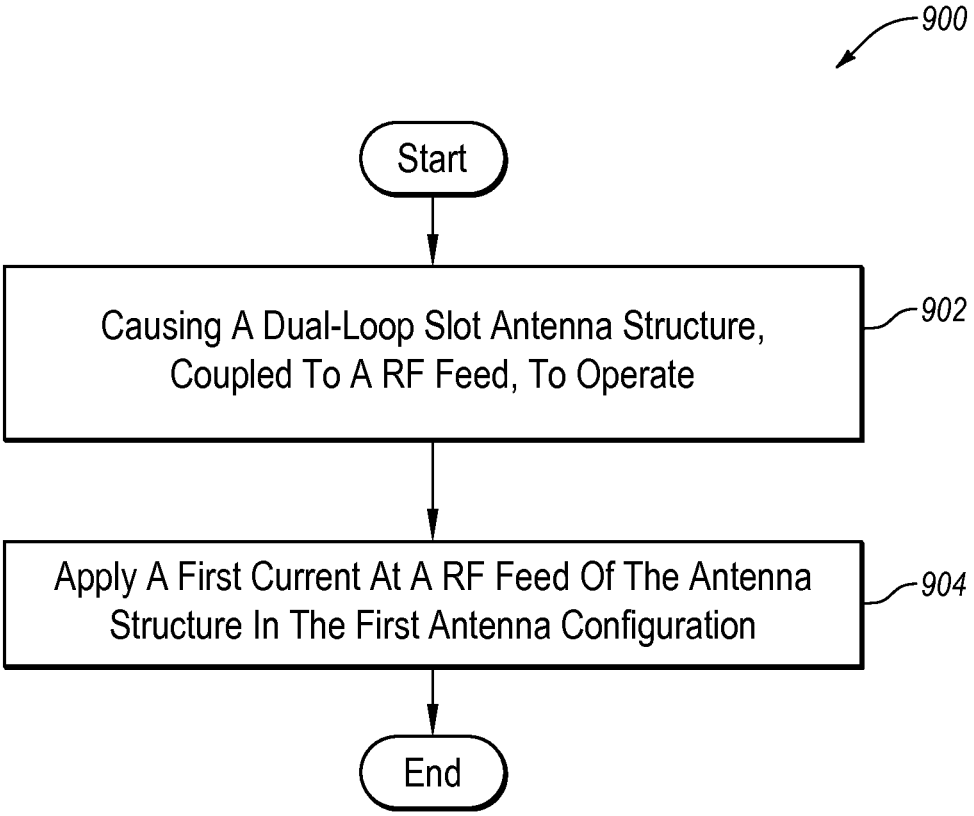
FIG. 9 is a flow diagram of an embodiment of a method of operating a user device having a dual-loop-slot antenna according to one embodiment.

FIG. 9 is a flow diagram of an embodiment of a method 900 of operating an electronic device having a dual-loop-slot antenna according to one embodiment. In method 900, an antenna structure (e.g., dual-loop-slot antenna 100) is caused to operate (block 902). The antenna structure is coupled to an RF feed. A current is applied to the antenna structure via the RF feed to drive the antenna structure to radiate electromagnetic energy (block 904). In response to applying the first current, electromagnetic energy is radiated from the antenna structure.

In response to the applied current(s), when applicable, the antenna structure radiates electromagnetic energy to communicate information to one or more other devices. Regardless of the antenna configuration, the electromagnetic energy forms a radiation pattern. The radiation pattern may be various shapes as would be appreciated by one of ordinary skill in the art having the benefit of this disclosure.

The antenna structure of the dual-loop-slot antenna can provide different resonant modes for various bands, such as a low-band, mid-band, high-band, or any combination thereof. For example, the antenna structure provides two low-band resonant modes and four high-band resonant modes. In one embodiment, the electromagnetic energy is radiated at a first frequency range of approximately 700 MHz to approximately 1 GHz and is radiated at a second frequency range of approximately 1.5 GHz to approximately 2.3 GHz. In another embodiment, the electromagnetic energy is radiated at a first frequency range of approximately 700 MHz to approximately 960 MHz and is radiated at a second frequency range of approximately 1.7 GHz to approximately 2.2 GHz.

Figure 10:
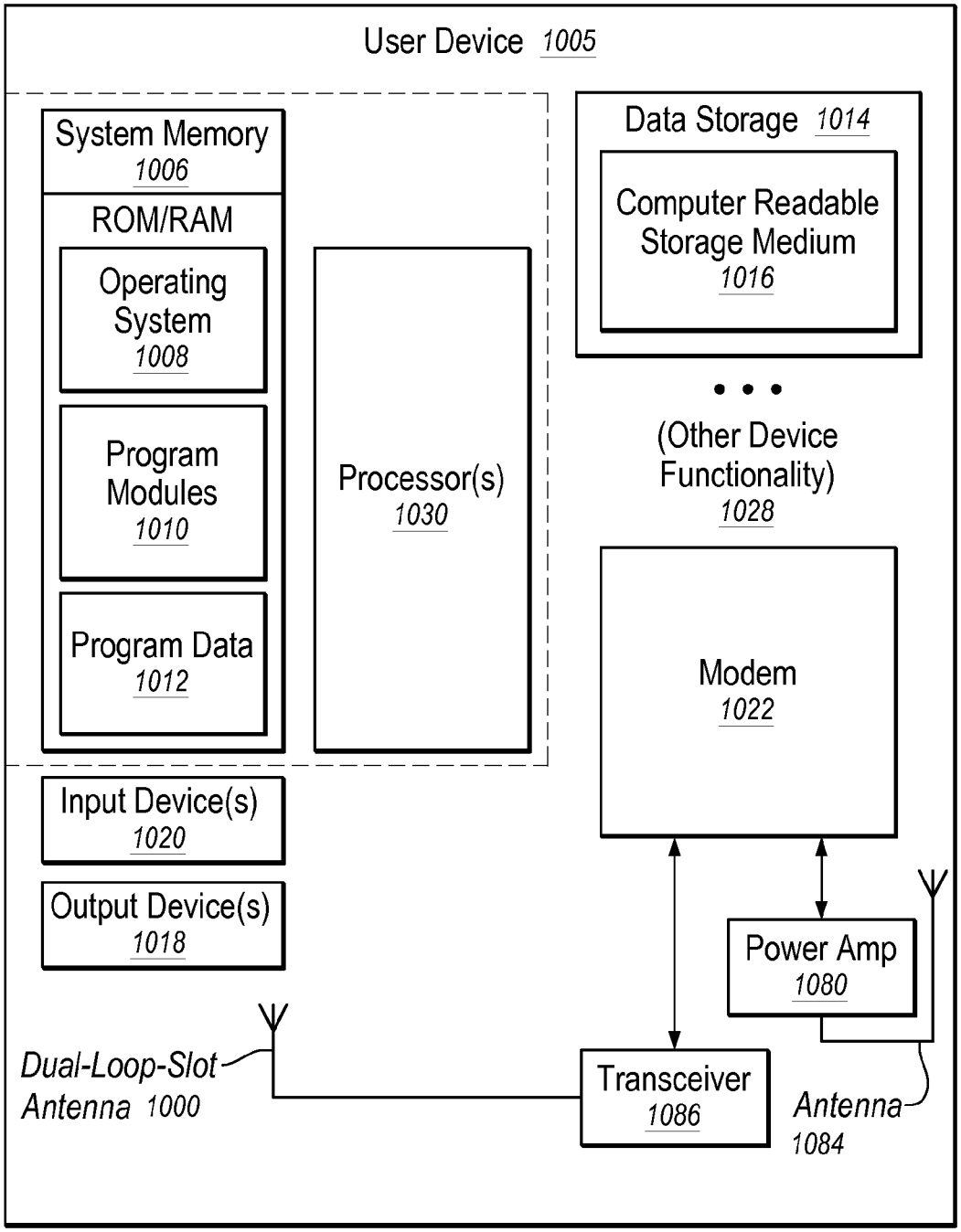
FIG. 10 is a block diagram of a user device having a dual-loop-slot antenna according to one embodiment.

FIG. 10 is a block diagram of a user device 1005 having the dual-loop-slot antenna 1000 according to one embodiment. The user device 1005 includes one or more processors 1030, such as one or more CPUs, microcontrollers, field programmable gate arrays, or other types of processing devices. The user device 1005 also includes system memory 1006, which may correspond to any combination of volatile and/or non-volatile storage mechanisms. The system memory 1006 stores information, which provides an operating system component 1008, various program modules 1010, program data 1012, and/or other components. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any one or more of the functions of the user device 1005, as described herein. As shown, instructions may reside, completely or at least partially, within the computer readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1020 (keyboard, mouse device, specialized selection keys, etc.) and one or more output devices 1018 (displays, printers, audio output mechanisms, etc.).

The user device 1005 further includes a wireless modem 1022 to allow the user device 1005 to communicate via a wireless network (e.g., such as provided by a wireless communication system) with other computing devices, such as remote computers, an item providing system, and so forth. The wireless modem 1022 allows the user device 1005 to handle both voice and non-voice communications (such as communications for text messages, multimedia messages, media downloads, web browsing, etc.) with a wireless communication system. The wireless modem 1022 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 1022 may communicate according to different communication types (e.g., WCDMA, GSM, LTE, CDMA, WiMax, etc.) in different cellular networks. The cellular network architecture may include multiple cells, where each cell includes a base station configured to communicate with user devices within the cell. These cells may communicate with the user devices 1005 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1005 to communicate with other devices, such as other user devices, server computing systems, telephone devices, or the like. In addition to wirelessly connecting to a wireless communication system, the user device 1005 may also wirelessly connect with other user devices. For example, user device 1005 may form a wireless ad hoc (peer-to-peer) network with another user device.

The wireless modem 1022 may generate signals and send these signals to power amplifier (amp) 1080 or transceiver 1086 for amplification, after which they are wirelessly transmitted via the dual-loop-slot antenna 1000 or antenna 1084, respectively. Although FIG. 10 illustrates power amp 1080 and transceiver 1086, in other embodiments, a transceiver may be used for all the antennas 1000 and 1084 to transmit and receive. Or, power amps can be used for both antennas 1000 and 1084. The antenna 1084, which is an optional antenna that is separate from the dual-loop-slot antenna 1000, may be any directional, omnidirectional or non-directional antenna in a different frequency band than the frequency bands of the dual-loop-slot antenna 1000. The antenna 1084 may also transmit information using different wireless communication protocols than the dual-loop-slot antenna 1000. In addition to sending data, the dual-loop-slot antenna 1000 and the antenna 1084 also receive data, which is sent to wireless modem 1022 and transferred to processor(s) 1030. It should be noted that, in other embodiments, the user device 1005 may include more or less components as illustrated in the block diagram of FIG. 10. In one embodiment, the dual-loop-slot antenna 1000 is the dual-loop-slot antenna 100 of FIG. 1. In another embodiment, the dual-loop-slot antenna 1000 is the dual-loop-slot antenna 100 of FIG. 5. Alternatively, the dual-loop-slot antenna 1000 may be other dual-loop-slot antennas as described herein.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the dual-loop-slot antenna 1000 that operates at a first frequency band and the second wireless connection is associated with a second resonant mode of the dual-loop-slot antenna 1000 that operates at a second frequency band. In another embodiment, the first wireless connection is associated with the dual-loop-slot antenna 1000 and the second wireless connection is associated with the antenna 1084. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1022 is shown to control transmission to both antennas 1000 and 1084, the user device 1005 may alternatively include multiple wireless modems, each of which is configured to transmit/receive data via a different antenna and/or wireless transmission protocol. In addition, the user device 1005, while illustrated with two antennas 1000 and 1084, may include more or fewer antennas in various embodiments.

The user device 1005 delivers and/or receives items, upgrades, and/or other information via the network. For example, the user device 1005 may download or receive items from an item providing system. The item providing system receives various requests, instructions and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:
an radio frequency (RF) feed; and
an antenna structure coupled to the RF feed, wherein the antenna structure comprises:
a ground plane;
a cascaded dual-loop antenna structure coupled to the RF feed and coupled to the ground plane, wherein the cascaded dual-loop antenna structure comprises:
a first portion coupled to the RF feed;
a second portion coupled directly to the ground plane, wherein the first portion and the second portion form a first loop;
a third portion that includes an entirety of the first portion; and
a fourth portion that includes an entirety of the second portion and connects directly to the third portion, wherein the third portion and the fourth portion form a second loop with the first loop cascaded within and as a part of the second loop; and
a slot antenna formed at least in part by a portion of the cascaded dual-loop antenna structure.

2. The electronic device of claim 1, wherein the first loop comprises a first effective length, wherein the second loop comprises a second effective length that is longer than the first effective length, and wherein the slot antenna comprises a third effective length, and wherein the slot antenna comprises a fifth portion that extends out from an outer perimeter of the second loop to form an opening between the fifth portion and the outer perimeter of the second loop.

3. The electronic device of claim 2, wherein the first portion comprises a first extension area disposed at a first distal end, the first distal end being an end farthest away from the RF feed, wherein the second portion comprises a second extension area disposed at a second distal end, the second distal end being an end farthest away from a grounding point at which the cascaded dual-loop antenna structure is coupled to the ground plane, and wherein the cascaded dual-loop antenna structure comprises a gap between the first extension area and the second extension area.

4. An apparatus comprising:
an radio frequency (RF) feed; and
an antenna structure coupled to the RF feed, wherein the antenna structure comprises:
a ground plane;
a first loop antenna coupled directly to the RF feed and the ground plane;
a second loop antenna coupled to the RF feed and the ground plane via the first loop antenna, wherein the second loop antenna is formed by and includes an entirety of the first loop antenna, wherein the first loop antenna comprises a first effective length, and wherein the second loop antenna comprises a second effective length that is longer than the first effective length,
wherein the second loop antenna extends beyond opposing ends of the first loop antenna; and
a slot antenna formed at least in part by a portion of at least one of the first loop antenna or the second loop antenna.

5. The apparatus of claim 4, wherein the first loop antenna comprises:
a first portion coupled to the RF feed; and
a second portion coupled to the ground plane, wherein the first portion and the second portion forms the first loop antenna, wherein the second loop antenna comprises:
a third portion coupled to the first portion; and
a fourth portion coupled to the second portion, wherein the first portion, second portion, third portion and fourth portion form the second loop antenna, and wherein the slot antenna comprises a sixth portion that extends out from an outer perimeter of the second loop antenna to form an opening between the sixth portion and the outer perimeter of the second loop antenna.

6. The apparatus of claim 4, wherein the slot antenna comprises a third effective length.

7. The apparatus of claim 5, wherein the first portion comprises a first extension area disposed at a first distal end, the first distal end being an end farthest away from the RF feed, wherein the second portion comprises a second extension area disposed at a second distal end, the second distal end being an end farthest away from a grounding point at which the first loop antenna is coupled to the ground plane, and wherein the antenna structure comprises a gap between the first extension area and the second extension area.

8. The apparatus of claim 4, further comprising a matching network coupled to the RF feed and the first loop antenna.

9. The apparatus of claim 8, wherein the matching network comprises a high-pass $\pi$ (pi) matching network.

10. The apparatus of claim 4, wherein the antenna structure is configured to radiate electromagnetic energy in six resonant modes.

11. The apparatus of claim 10, wherein two of the six resonant modes operate in a first frequency range of a standard wireless frequency band and four of the six resonant modes operate in a second frequency range of the standard wireless frequency band, wherein the second frequency range is higher than the first frequency range.

12. The apparatus of claim 11, wherein the first frequency range is approximately 700 MHz to approximately 1.0 GHz and the second frequency range is approximately 1.5 GHz to approximately 2.2 GHz.

13. The apparatus of claim 10, wherein a first resonant mode of the six resonant modes is at approximately 700 MHz, a second resonant mode of the six resonant modes is at approximately 900 MHz, a third resonant mode of the six resonant modes is at approximately 1.5 GHz, a fourth resonant mode of the six resonant modes is at approximately 1.7 GHz, a fifth resonant mode of the six resonant modes is at approximately 1.9 GHz and a sixth resonant mode of the six resonant modes is at approximately 2.17 GHz.

14. The apparatus of claim 4, wherein first loop antenna and the second loop antenna form a cascaded dual-loop and slot antenna structure, and wherein the slot antenna comprises a portion that extends out from an outer perimeter of the second loop antenna to form an opening between the portion and the outer perimeter of the second loop antenna.

15. The apparatus of claim 4, wherein the slot antenna comprises a portion that extends out from an outer perimeter of the first loop antenna to form an opening between the portion and the outer perimeter of the first loop antenna, and wherein the second loop antenna is disposed at least partially outside of the slot antenna.

16. The apparatus of claim 4, wherein the first loop antenna, second loop antenna and slot antenna are disposed on a same plane.

17. The apparatus of claim 4, wherein the first loop antenna is disposed on a first plane and at least a portion of the second loop is disposed on a second plane.

18. The apparatus of claim 4, wherein the slot antenna is a half-wave length slot antenna.

19. A method of operating an electronic device comprising:

causing an antenna structure to operate, wherein the antenna structure comprises:

a ground plane;

a first loop antenna coupled directly to a radio frequency (RF) feed and the ground plane;

a second loop antenna coupled to the RF feed and the ground plane via the first loop antenna, wherein the second loop antenna is formed by and includes an entirety of the first loop antenna, wherein the first loop antenna comprises a first effective length, the second loop antenna comprises a second effective length that is longer than the first effective length, and wherein the second loop antenna extends beyond opposing ends of the first loop antenna; and a slot antenna formed at least in part by a portion of at least one of the first loop antenna or the second loop antenna; and applying a first current to the RF feed coupled to the antenna structure.

20. The method of claim 19, further comprising:

causing the antenna structure to radiate electromagnetic energy at a first frequency range of approximately 700 MHz to approximately 1.0 GHz; and causing the antenna structure to radiate electromagnetic energy at a second frequency range of about 1.5 GHz to about 2.2 GHz.

* * * * *